US011005166B2

(12) United States Patent
Hwang et al.

(10) Patent No.: US 11,005,166 B2
(45) Date of Patent: May 11, 2021

(54) PATCH ANTENNA MODULE

(71) Applicant: AMOTECH CO., LTD., Namdong-gu Incheon (KR)

(72) Inventors: Chul Hwang, Seo-gu Incheon (KR); In-Jo Jeong, Dong-gu Incheon (KR); Sang-O Kim, Namdong-gu Incheon (KR); Dong-Hwan Koh, Dobong-gu Seoul (KR); Won-Hee Lee, Nam-gu Incheon (KR); Hyun-Woo Oh, Nam-gu Incheon (KR)

(73) Assignee: AMOTECH CO., LTD., Incheon (KR)

( * ) Notice: Subject to any disclaimer, the term of this patent is extended or adjusted under 35 U.S.C. 154(b) by 90 days.

(21) Appl. No.: 16/325,141

(22) PCT Filed: Aug. 16, 2017

(86) PCT No.: PCT/KR2017/008865
§ 371 (c)(1),
(2) Date: Feb. 12, 2019

(87) PCT Pub. No.: WO2018/034478
PCT Pub. Date: Feb. 22, 2018

(65) Prior Publication Data

US 2019/0190132 A1 Jun. 20, 2019

(30) Foreign Application Priority Data

Aug. 16, 2016 (KR) ..... 10-2016-0103807

(51) Int. Cl.
*H01Q 1/32* (2006.01)
*H01Q 9/04* (2006.01)
*H01Q 1/46* (2006.01)

(52) U.S. Cl.
CPC ..... *H01Q 1/32* (2013.01); *H01Q 1/46* (2013.01); *H01Q 9/04* (2013.01); *H01Q 9/045* (2013.01); *H01Q 9/0485* (2013.01)

(58) Field of Classification Search
CPC ..... H01Q 1/32; H01Q 1/46; H01Q 1/3233; H01Q 1/3225; H01Q 9/04; H01Q 9/045; H01Q 5/364; H01Q 9/0407; H04W 4/40
(Continued)

(56) References Cited

U.S. PATENT DOCUMENTS

2011/0090134 A1* 4/2011 Shinohara ..... H02G 5/068 343/892

FOREIGN PATENT DOCUMENTS

CN 103682590 A 3/2014
DE 102010015823 A1 * 10/2011 ..... H01Q 9/0407
(Continued)

OTHER PUBLICATIONS

Callaghan, et al., "Dual-Band Pin-Patch Antenna for Wi-Fi Applications" IEEE Antennas and Wireless Propagation Letters, XP011330796, vol. 7, 2008, pp. 757-760 (Year: 2008).*
(Continued)

*Primary Examiner* — Alexander H Taningco
*Assistant Examiner* — Amy X Yang
(74) *Attorney, Agent, or Firm* — CL Intellectual LLC

(57) ABSTRACT

Disclosed is a patch antenna module, which receives a signal for position information and a signal for vehicle communication by using one patch antenna, thereby minimizing a mounting space. The disclosed patch antenna module includes a dielectric; an upper patch formed on one surface of the dielectric and for receiving a signal for position information; a lower patch formed on the other surface of the dielectric; and a feed pin for penetrating the dielectric, the upper patch, and the lower patch, formed in a length within
(Continued)

a predetermined range, and for receiving a signal for vehicle communication.

8 Claims, 6 Drawing Sheets

(58) Field of Classification Search
USPC ..... 343/711
See application file for complete search history.

(56) References Cited

FOREIGN PATENT DOCUMENTS

| | | | | |
|---|---|---|---|---|
| DE | 102010015823 | A1 | 10/2011 | |
| KR | 10-1998-0034451 | A | 8/1998 | |
| KR | 2003-0044171 | A | 6/2003 | |
| KR | 10-2008-0112493 | A | 12/2008 | |
| KR | 10-2012-0032752 | A | 4/2012 | |
| KR | 10-2014-0095130 | A | 8/2014 | |
| WO | 2007136182 | A1 | 11/2007 | |
| WO | WO-2007136182 | A1 * | 11/2007 | ..... H01Q 23/00 |

OTHER PUBLICATIONS

English translation of Office Action issued in Chinese Application No. 201780052343.4, dated Feb. 3, 2020.
Extended Search Report issued in European Application No. 17841660.8, dated Feb. 11, 2020.
Callaghan, et al., "Dual-Band Pin-Patch Antenna for Wi-Fi Applications" IEEE Antennas and Wireless Propagation Letters, XP011330796, vol. 7, 2008, pp. 757-760.

* cited by examiner

[FIG. 1]
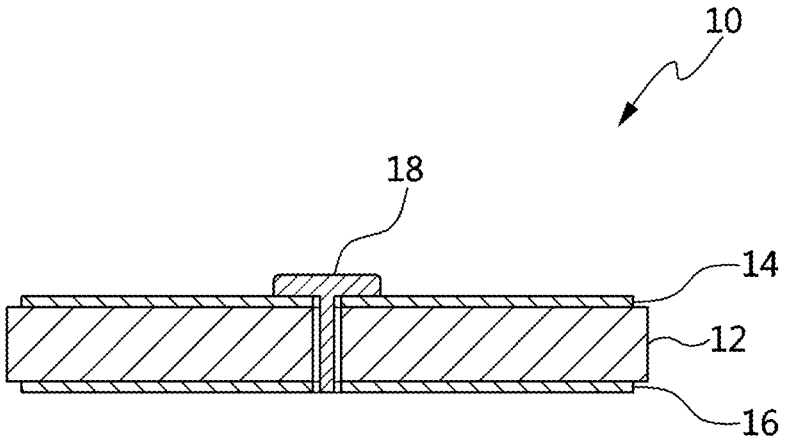

[FIG. 2]
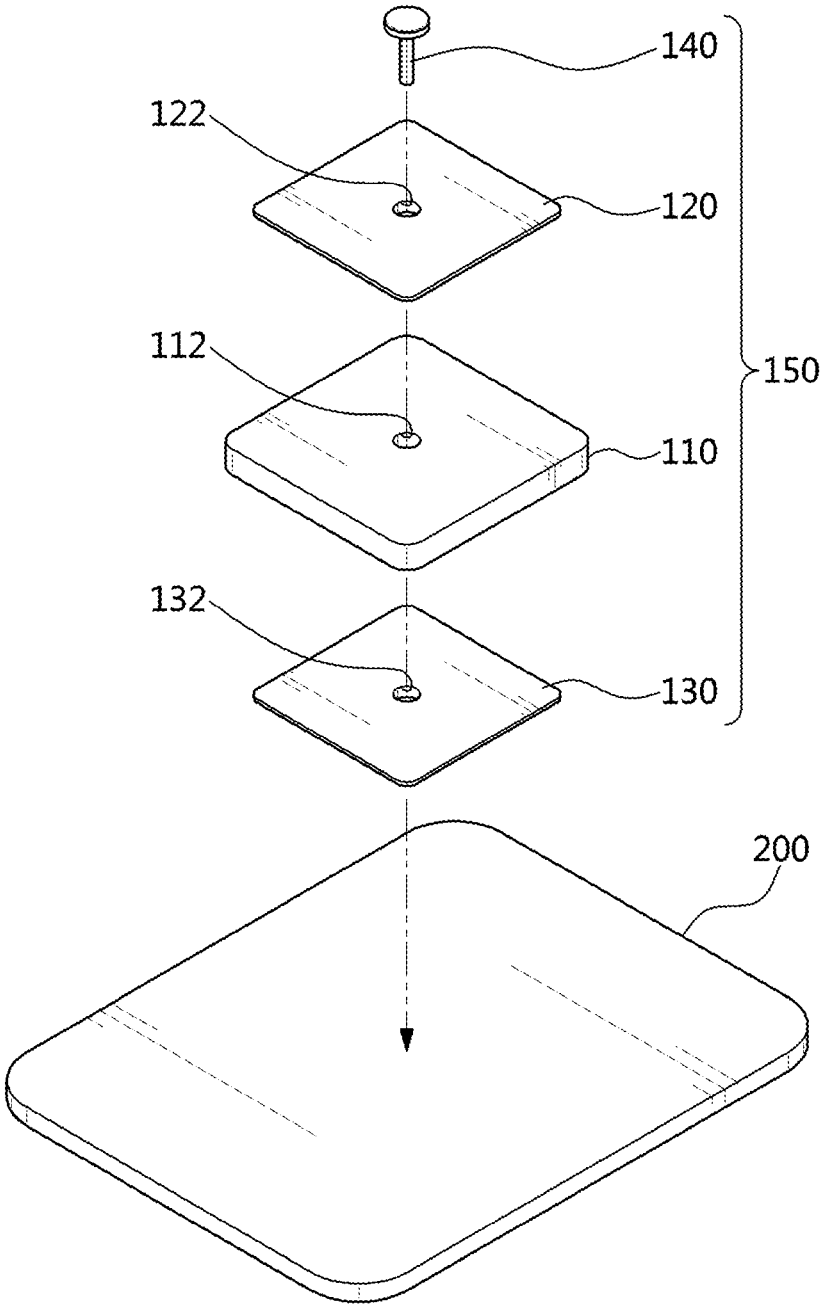

[FIG. 3]
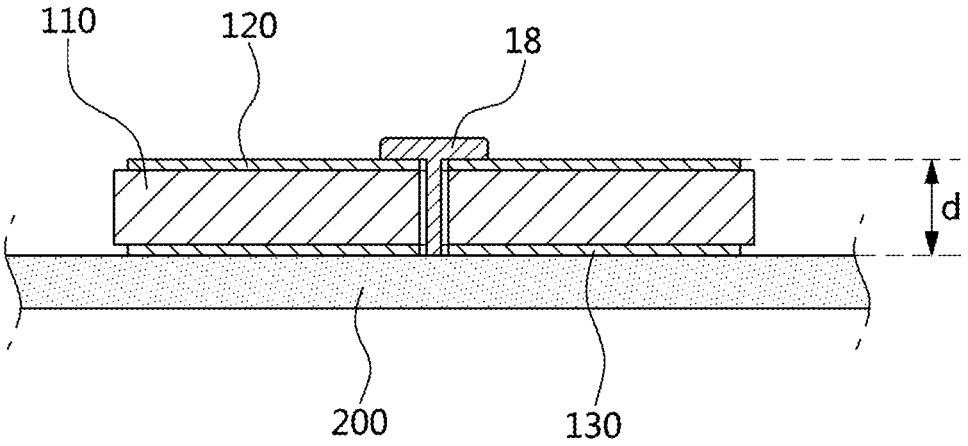
[FIG. 4]
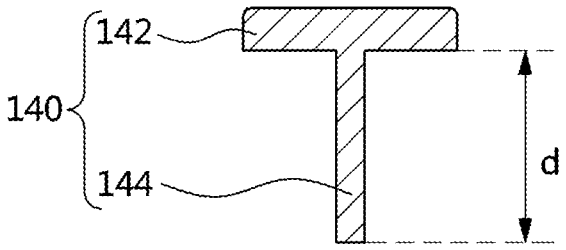

[FIG. 5]

| LENGTH OF FEED PIN(MM) | GPS BAND FREQUENCY(MHZ) | V2X (WAVE) BAND FREQUENCY(MHZ) | VSWR@V2X BAND |
|---|---|---|---|
| 4.0 | 1575.42 | 6063.00 | 3.12 @5850MHz<br>3.07 @5925MHz |
| 4.5 | 1575.42 | 6008.00 | 2.49 @5850MHz<br>2.20 @5925MHz |
| 5.0 | 1575.42 | 5942.00 | 1.86 @5850MHz<br>1.19 @5925MHz |
| 5.5 | 1575.42 | 5887.00 | 1.19 @5850MHz<br>1.23 @5925MHz |
| 6.0 | 1575.42 | 5821.00 | 1.20 @5850MHz<br>1.41 @5925MHz |
| 6.5 | 1575.42 | 5799.00 | 1.54 @5850MHz<br>1.73 @5925MHz |
| 7.0 | 1575.42 | 5776.00 | 1.91 @5850MHz<br>1.95 @5925MHz |
| 7.5 | 1575.42 | 5766.00 | 2.10 @5850MHz<br>1.15 @5925MHz |
| 8.0 | 1575.42 | 5755.00 | 2.50 @5850MHz<br>2.34 @5925MHz |
| 8.5 | 1575.42 | 5744.00 | 2.74 @5850MHz<br>2.61 @5925MHz |
| 9.0 | 1575.42 | 5710.00 | 2.97 @5850MHz<br>2.80 @5925MHz |
| 9.5 | 1575.42 | 5673.00 | 3.19 @5850MHz<br>3.07 @5925MHz |

[FIG. 6]
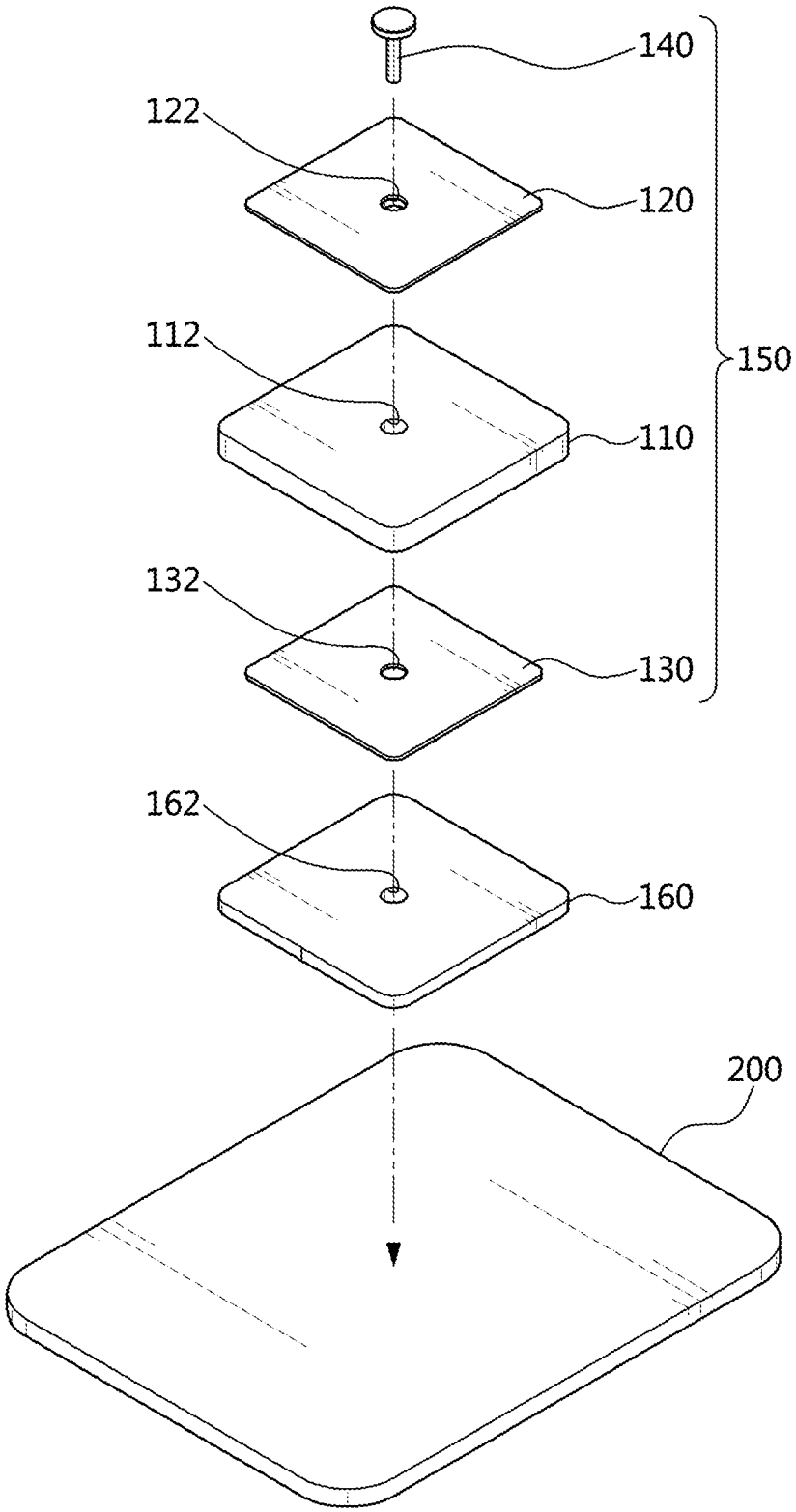

[FIG. 7]
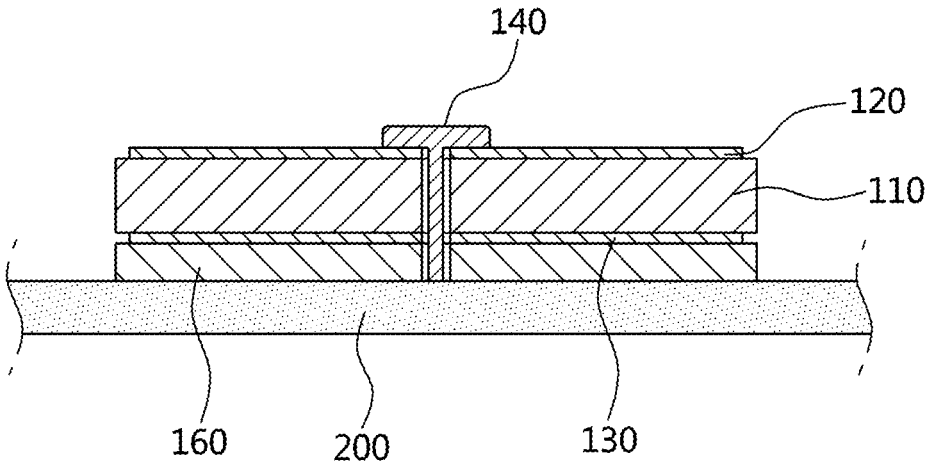
[FIG. 8]
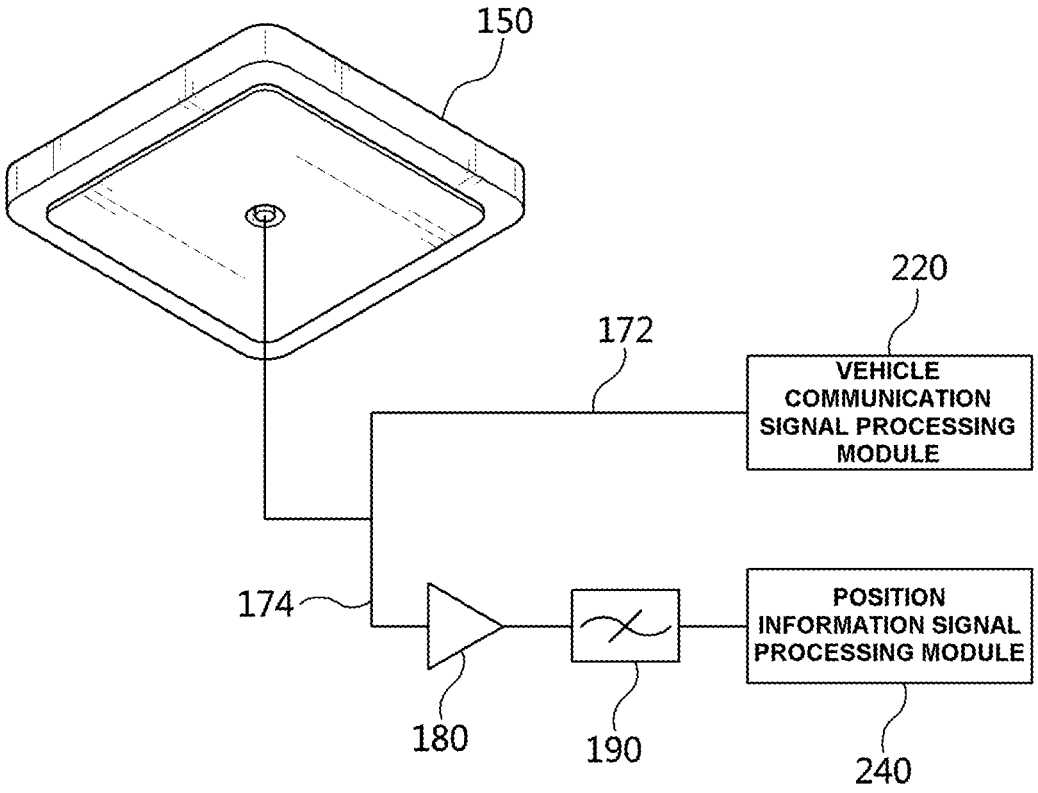

PATCH ANTENNA MODULE

CROSS-REFERENCE TO RELATED APPLICATIONS

This application is a National Stage of International patent application PCT/KR2017/008865, filed on Aug. 16, 2017, which claims priority to foreign Korean patent application No. KR 10-2016-0103807 filed on Aug. 16, 2016, the disclosures of which are incorporated by reference in their entirety.

FIELD OF THE INVENTION

The present disclosure relates to a patch antenna module used in a vehicle, and more particularly, to a patch antenna module, which resonates in a frequency band used for GPS communication and vehicle communication on the road.

Various types of antennas are installed in a vehicle to increase the ease of operation and increase the efficiency of the movement.

For example, the vehicle is equipped with a Global Navigation Satellite System (GNSS) antenna for service using position information, a Satellite Digital Audio Radio Service (SDARS) antenna for digital satellite broadcasting service, and the like.

The GNSS antenna provides position information through communication with satellites such as GPS, Glonass, Galileo, and the like, and the SDARS antenna provides high quality voice broadcasting through communication with digital satellites.

At this time, the GNSS antenna and the SDARS antenna are composed of a planar patch antenna to be embedded in a shark antenna installed on a roof panel of the vehicle.

Meanwhile, in recent years, studies are underway to apply a Vehicle To X (V2X) technology to the vehicle in order to increase the safety of driving.

The V2X means all types of communication methods applicable to vehicles on the road, such as Vehicle To Vehicle (V2V) that is communication between vehicles, Vehicle To Infrastructure (V2I) that is communication between a vehicle and an infrastructure, Vehicle To Grid (V2G) that is communication between a vehicle and a grid, and Vehicle To Nomadic (V2N) that is communication between a vehicle and a device.

In order to use the V2X, a V2X antenna that resonates at a band of about 5.9 GHz should be installed in a vehicle. At this time, the frequency band of the V2X antenna is defined by the WAVE standard specified in IEEE 802.11p.

It is preferable that the V2X antenna is installed in the shark antenna installed on the roof panel of the vehicle because it should be installed outside the vehicle to smoothly communicate with other vehicles, infrastructures, grids and devices.

However, a large number of antennas such as the GNSS antenna and the SDARS antenna are mounted on the shark antenna, such that it is difficult to further mount the V2X antenna thereon because the mounting space is insufficient.

SUMMARY OF THE INVENTION

The present disclosure is intended to solve the above problem, and an object of the present disclosure is to provide a patch antenna module, which receives a signal for position information and a signal for vehicle communication by using one patch antenna, thereby minimizing a mounting space.

For achieving the object, a patch antenna according to an embodiment of the present disclosure, as the patch antenna module mounted on a printed circuit board, includes a dielectric; an upper patch formed on one surface of the dielectric and for receiving a signal for position information; a lower patch formed on the other surface of the dielectric; and a feed pin for penetrating the dielectric, the upper patch, and the lower patch, formed in a length within a predetermined range, and for receiving a signal for vehicle communication.

At this time, the length of the feed pin may be a length from the upper patch to the ground surface of the printed circuit board. The feed pin includes a head mounted on the upper patch; and a main body for penetrating the dielectric, the upper patch, and the lower patch, and the length of the feed pin may be a length of the main body.

The length within a predetermined range of the feed pin may be formed at 4.5 mm or more and 9.0 mm or less. At this time, the length within a predetermined range of the feed pin may preferably be 5.0 mm or more and 7.0 mm or less, and the length within a predetermined range of the feed pin may more preferably be 5.5 mm or more and 6.0 mm or less.

The patch antenna module according to an embodiment of the present disclosure may further include a spacer interposed between the lower patch and the printed circuit board. At this time, the spacer is formed to have a thickness corresponding to a value obtained by subtracting the thicknesses of the dielectric and the upper patch and the lower patch from the length of the feed pin, and the spacer may be a double-sided tape.

The patch antenna module according to an embodiment of the present disclosure may further include a signal line having one end connected to the feed pin, and having the other end connected to a vehicle communication signal processing module; and another signal line having one end connected to the feed pin, and having the other end connected to a position information signal processing module of the printed circuit board through a low-noise amplifier and a band-pass filter.

According to the present disclosure, it is possible for the patch antenna module to receive the signal for position information and the signal for vehicle communication by using one patch antenna, thereby minimizing the mounting space.

In addition, it is possible for the patch antenna module to constitute the feed pin as the antenna for vehicle communication, thereby easily adjusting the resonance frequency of the communication band for vehicle communication through the adjustment of the length of the feed pin.

In addition, it is possible for the patch antenna module to interpose the spacer between the patch antenna and the printed circuit board when the feed pin having a length longer than the thickness of the patch antenna is applied, thereby firmly attaching the patch antenna to the printed circuit board while receiving the signal for position information and the signal for vehicle communication.

BRIEF DESCRIPTION OF THE DRAWINGS

FIG. 1 is a diagram for explaining a general patch antenna for position information.

FIG. 2 is a diagram for explaining a structure of a patch antenna according to an embodiment of the present disclosure.

FIGS. 3 and 4 are diagrams for explaining a feed pin of FIG. 2.

FIG. 5 is a diagram for explaining the characteristic of the patch antenna according to an embodiment of the present disclosure.

FIGS. 6 and 7 are diagrams for explaining a modified example of the patch antenna according to an embodiment of the present disclosure.

FIG. 8 is a diagram for explaining another modified example of the patch antenna according to an embodiment of the present disclosure.

DETAILED DESCRIPTION

Hereinafter, the most preferred embodiment of the present disclosure will be described with reference to the accompanying drawings so that those skilled in the art to which the present disclosure pertains may easily practice the technical spirit of the present disclosure. First, in adding reference numerals to the components in each drawing, it is to be noted that the same components are denoted by the same reference numerals even though they are illustrated in different drawings. In addition, in the following description of the present disclosure, a detailed description of known configurations or functions will be omitted when it is determined to obscure the subject matter of the present disclosure.

Referring to FIG. 1, a general patch antenna for position information 10 is configured to include a dielectric 12 having a predetermined dielectric constant, an upper patch 14 formed on one surface of the dielectric 12, a lower patch 16 formed on the other surface of the dielectric 12, and a feed pin 18. Herein, the patch antenna for position information 10 means a patch antenna for Global Navigation Satellite Service (GNSS) that resonates in a GPS band, a Glonass band, a Beidou band, a Galileo band, and the like.

At this time, the resonance frequency of the patch antenna for position information 10 is affected by the dielectric constant of the dielectric 12 and the size of the electrode (i.e., the upper patch 14), and is not affected by the length of the feed pin 18. Herein, the resonance frequency of the patch antenna for position information 10 is about 1.575 GHz for GPS, about 1.598 GHz for Glonass, about 1.559 GHz for Beidou, and about 1.598 GHz for Galileo.

On the other hand, the resonance frequency of the patch antenna for vehicle communication is not affected by the dielectric constant of the dielectric 12 and the size of the electrode, and is influenced only by the length of the feed pin 18. Herein, the resonance frequency of the patch antenna for vehicle communication has a bandwidth of about 5.850 GHz to 5.925 GHz for Vehicle To X (V2X) or WAVE.

As a result of varying the length of the feed pin 18 to 4 mm, 5.2 mm, 6.4 mm, and 7.6 mm in order to test the variations of the resonance frequency of the V2X band and the resonance frequency of the GPS band according to the variation of the length of the feed pin 18 included in the patch antenna for position information 10, the resonance frequency of the GPS band is not changed according to the variation of the length of the feed pin 18, but the resonance frequency of the V2X band is changed.

At this time, as the length of the feed pin 18 lengthens from 4 mm to 7.6 mm, the resonance frequency of the GPS band is not changed, but the resonance frequency of the V2X band decreases.

As a result, it may be seen that the feed pin 18 itself operates as a monopole antenna that resonates in the V2X band (i.e., about 5.9 GHz).

At this time, the frequency of the V2X band is not affected by the size of the electrode and is slightly affected by the dielectric constant of the dielectric, but since the dielectric 12 having a dielectric constant of about 20.5 is always used in the patch antenna for position information 10 having a size of 25×25 mm, the dielectric constant is not changed.

Therefore, the influence on the V2X band frequency may be excluded from consideration.

The fact that the feed pin 18 operates with an antenna of the V2X band of about 5.9 GHz means that the resonance frequency is 5.9 GHz. In the monopole antenna, a resonance frequency is formed when the current direction of the antenna is changed. That is, when the feed pin 18 and the upper patch 14 are connected, the current direction is changed by 90 degrees, such that the feed pin 18 operates as the V2X band antenna.

The patch antenna module according to an embodiment of the present disclosure provides a patch antenna module that resonates in the GPS band and the V2X band (or the WAVE band) by using one patch antenna considering the above-described characteristics.

Referring to FIG. 2, a patch antenna module 100 is configured to include a dielectric 110, an upper patch 120, a lower patch 130, and a feed pin 140.

At this time, the dielectric 110, the upper patch 120, the lower patch 130, and the feed pin 140 are connected to receive a signal for position information, and to drive as the antenna for transmitting and receiving a signal for vehicle communication.

However, in receiving the signal for position information, the upper patch 120 is the most important receiving element (i.e., the most important element for determining the resonance frequency), and in transmitting and receiving the signal for vehicle communication, the feed pin 140 is the most important element (i.e., the most important element for determining the resonance frequency), such that it is described in the following description that the upper patch 120 receives the signal for position information, and the feed pin 140 transmits and receives the signal for vehicle communication.

The dielectric 110 is formed of a dielectric material having a predetermined size (i.e., thickness, width). That is, the dielectric 110 is generally formed by using a ceramic having the characteristics such as a high dielectric constant and a low thermal expansion coefficient to have a predetermined dielectric constant. At this time, the dielectric 110 is composed of a ceramic having a thickness of about 4T to 6T. The dielectric constant of the dielectric 110 is determined according to the size and the material thereof, and the size and the material of the dielectric 110 may be changed according to the sizes and the materials of the upper patch 120 and the lower patch 130.

The dielectric 110 has a dielectric through-hole 112 into which the feed pin 140 is inserted formed therein. That is, the dielectric 110 has the through-hole into which the feed pin 140 for feeding the upper patch 120 is inserted formed therein.

The upper patch 120 is formed on one surface of the dielectric 110. That is, the upper patch 120 is formed of a thin plate of a conductive material having high electrical conductivity such as copper, aluminum, gold, and silver, and is formed on the upper surface of the dielectric 110. At this time, the upper patch 120 is driven as a radiator for receiving a GPS signal.

The upper patch 120 has an upper through-hole 122 through which the feed pin 140 passes formed therein. That is, the upper patch 120 has the upper through-hole 122 at a position corresponding to the dielectric through-hole 112 formed in the dielectric 110 formed. At this time, the upper patch 120 penetrates the through-hole and is fed through the feed pin 140 connected to the feed end (not illustrated) of a printed circuit board 200 to form a radiation field. The upper patch 120 receives the GPS signal through the radiation field.

The lower patch 130 is formed on the other surface of the dielectric 110. That is, the lower patch 130 is formed of a thin plate of the same material as the upper patch 120, and is formed on the lower surface of the dielectric 110. At this time, the lower patch 130 has a lower through-hole 132 through which the feed pin 140 passes formed therein. That is, the lower patch 130 has the lower through-hole 132 at a position corresponding to the dielectric through-hole 112 and the upper through-hole 122 formed therein.

The feed pin 140 penetrates the upper through-hole 122, the dielectric through-hole 112 and the lower through-hole 132 to be connected to the feed end (not illustrated) of the printed circuit board 200. The feed pin 140 applies the power applied from the feed end to the upper patch 120.

The feed pin 140 operates as an antenna that resonates in the V2X band. That is, the feed pin 140 operates as an antenna that resonates in the V2X band together with the feeding operation of the upper patch 120. For this purpose, the feed pin 140 is formed to have a length of about 4.5 mm or more and 9.0 mm or less.

Herein, referring to FIG. 3, the length of the feed pin 140 refers to the distance d from the upper patch 120 to the ground plane of the printed circuit board 200 on which the patch antenna module 100 is mounted.

At this time, referring to FIG. 4, when the feed pin 140 is divided into a head 142 and a main body 144, the length of the main body 144 may also be the length of the feed pin 140.

FIG. 5 illustrates the results of measuring the frequency of the V2X band and a voltage standing wave ratio (VSWR) at an interval of 0.5 mm from 4.0 mm to 9.5 mm in the length of the feed pin 140.

When the feed pin 18 is formed in a length of less than 4.5 mm or in a length of more than 9.0 mm, the feed pin 140 is formed to have a voltage standing wave ratio of about 3 or more and may not receive a signal in the V2X band because the center frequency deviates much from the V2X band, or part of the signal may be missing.

Therefore, the feed pin 140 is preferably formed to have a length of 4.5 mm or more and 9.0 mm or less in order to resonate in the V2X band. At this time, the feed pin 140 forms a voltage standing wave ratio of 3.0 or less, and forms the center frequency having a difference of about 2 GHz or less from the 5.9 GHz to drive as the antenna of the V2X band.

Meanwhile, when the feed pin 140 is formed in a length of 4.5 mm or more and 5.0 mm or less or more than 7.5 mm and 9.0 mm or less, it may operate as the antenna of the V2X band, but the voltage standing wave ratio is 3 or more and the center frequency is slightly deviated from the V2X band, such that the antenna performance is reduced.

Therefore, the feed pin 140 is preferably formed to have a length of about 5.0 mm or more and 7.0 mm or less. At this time, since the feed pin 140 is formed to have a voltage standing wave ratio of about 2 or less and to have the center frequency in the V2X band, the antenna performance may be prevented from being reduced.

On the other hand, the feed pin 140 is more preferably formed in a length of about 5.5 mm or more and 6.0 mm or less. At this time, since the feed pin 140 is formed to have a voltage standing wave ratio of about 1.5 or less and to have the center frequency in the V2X band, the antenna performance may be optimized.

Referring to FIGS. 6 and 7, the patch antenna module 100 may further include a spacer 160. That is, in order to implement an antenna of the V2X band, the patch antenna module 100 may further include the spacer 160 when the length of the feed pin is formed in a length longer than the thickness obtained by summing the thicknesses of the dielectric 110 and the upper patch 120 and the lower patch 130 (hereinafter, the thickness of a patch antenna 150).

The spacer 160 is interposed between the lower patch 130 and the printed circuit board 200. The spacer 160 is composed of a double-sided tape or nonwoven fabric to compensate for the difference between the length of the feed pin 140 and the thickness of the patch antenna 150.

That is, when the thickness of the patch antenna 150 is shorter than the length of the feed pin 140, a part of the feed pin 140 is exposed to the outside, and the lower surface of the patch antenna module 100 does not closely contact with the printed circuit board 200. When the patch antenna 150 is not mounted in close contact with the printed circuit board 200, the patch antenna 150 is detached from the printed circuit board 200 even by the movement of the vehicle or a small impact.

Therefore, the spacer 160 is formed to have a thickness corresponding to a value obtained by subtracting the thickness of the patch antenna 150 from the length of the feed pin 140 so that the patch antenna 150 is mounted in a close contact with the printed circuit board 200. For example, when the thickness of the dielectric 110 is 4 mm and the length of the feed pin 140 is 5.2 mm, the spacer 160 is formed to have a thickness of about 1.2 mm.

The spacer 160 has a spacer through-hole 162 through which the feed pins 140 pass formed therein. At this time, the spacer 160 has the spacer through-hole 162 at a position corresponding to the dielectric through-hole 112, the upper through-hole 122, and the lower through-hole 132 formed therein.

As a result, it is possible for the patch antenna module 100 to firmly attach the patch antenna module 100 to the printed circuit board 200 while implementing the antenna of the V2X band.

Referring to FIG. 8, the patch antenna module 100 may further include a low-noise amplifier 180 and a band-pass filter 190. That is, the patch antenna module 100 operates as an antenna for position information and an antenna for vehicle communication (i.e., V2X, WAVE) by using one patch antenna 150. The signal received by the patch antenna 150 is branched along signal lines 172, 174 to be transmitted to a vehicle communication signal processing module 220 and a position information signal processing module 240.

At this time, since the position information signal processing module 240 performs only unidirectional communication (i.e., reception), the low-noise amplifier 180 and the band-pass filter 190 are connected to the signal line 174 connected to the position information signal processing module 240.

In contrast, since the vehicle communication signal processing module 220 performs bidirectional communication (i.e., transmission and reception), the low-noise amplifier 180 or the band-pass filter 190 are not connected thereto, and the vehicle communication signal processing module 220 and the feed pin 140 are directly connected thereto.

As described above, it is possible for the patch antenna module to receive the signal for position information and the signal for vehicle communication by using one patch antenna, thereby minimizing the mounting space.

In addition, it is possible for the patch antenna module to constitute the feed pin as the antenna for vehicle communication, thereby easily adjusting the resonance frequency of the communication band for vehicle communication through the adjustment of the length of the feed pin.

In addition, it is possible for the patch antenna module to interpose the spacer between the patch antenna and the printed circuit board when the feed pin having a length longer than the thickness of the patch antenna is applied thereto, thereby firmly attaching the patch antenna to the printed circuit board while receiving the signal for position information and the signal for vehicle communication.

As described above, although preferred embodiments of the present disclosure have been described, it is to be understood that they may be modified into various forms, and various modifications and changes thereof may be embodied by those skilled in the art to which the present disclosure pertains without departing from the scope of the present disclosure.

The invention claimed is:

1. A patch antenna module, comprising:

a printed circuit board, a dielectric disposed on an upper surface of the printed circuit board;

an upper patch formed on an upper surface of the dielectric and for receiving a signal for position information;

a lower patch formed on a lower surface of the dielectric to be interposed between the printed circuit board and the dielectric; and a feed pin for penetrating the dielectric, the upper patch, and the lower patch, formed in a length within a predetermined range, and for receiving a signal for vehicle communication, wherein the length of the feed pin is a length from the upper patch to the ground surface of the printed circuit board, and wherein the length within a predetermined range of the feed pin is 4.5 mm or more and 9.0 mm or less.

2. The patch antenna module of claim 1, wherein the feed pin comprises a head mounted on the upper patch; and a main body for penetrating the dielectric, the upper patch, and the lower patch, wherein the length of the feed pin is a length of the main body.

3. The patch antenna module of claim 1, wherein the length within a predetermined range of the feed pin is 5.0 mm or more and 7.0 mm or less.

4. The patch antenna module of claim 1, wherein the length within a predetermined range of the feed pin is 5.5 mm or more and 6.0 mm or less.

5. The patch antenna module of claim 1, further comprising a spacer interposed between the lower patch and the printed circuit board.

6. The patch antenna module of claim 5, wherein the spacer is formed to have a thickness corresponding to a value obtained by subtracting the thicknesses of the dielectric and the upper patch and the lower patch from the length of the feed pin.

7. The patch antenna module of claim 5, wherein the spacer is a double-sided tape.

8. The patch antenna module of claim 1, further comprising a signal line having one end connected to the feed pin, and having the other end connected to a vehicle communication signal processing module; and another signal line having one end connected to the feed pin, and having the other end connected to a position information signal processing module of the printed circuit board through a low-noise amplifier and a band-pass filter.

* * * * *